United States Patent [19]

Mark

[11] 4,403,623

[45] Sep. 13, 1983

[54] COMBINED TOOTHBRUSH AND GUM MASSAGE DEVICE

[75] Inventor: Reuben Mark, Greenwich, Conn.

[73] Assignee: Colgate-Palmolive Company, New York, N.Y.

[21] Appl. No.: 321,877

[22] Filed: Nov. 16, 1981

[51] Int. Cl.[3] ..... A45D 44/18

[52] U.S. Cl. ..... 132/84 R; 15/172

[58] Field of Search ..... 132/84 R, 84 A; 15/172, 15/167 R, 110, 144 R

[56] References Cited

U.S. PATENT DOCUMENTS

| | | | |
|---|---|---|---|
| 1,439,913 | 12/1922 | Saxe | 15/172 |
| 1,439,914 | 12/1922 | Saxe | 15/172 |
| 2,618,801 | 11/1952 | Hibbs | 15/167 R |
| 4,033,008 | 7/1977 | Warren | 15/167 R |
| 4,333,199 | 6/1982 | Del Rosario | 15/167 R |

*Primary Examiner*—Gregory E. McNeill

*Attorney, Agent, or Firm*—Herbert S. Sylvester; Murray M. Grill; John A. Stemwedel

[57] ABSTRACT

A dental hygiene device for toothbrushing and gum massage comprises an elongated handle on which a bristle carrying head is pivotable for movement between a first operating position in alignment with the length of the handle and a second operating position at right angles to the length of said handle, there being a rib and groove arrangement for locking the head in either of those positions during normal toothbrushing and/or gum massaging operations but being readily responsive to torque applied by a user to turn the head from one position to another. The head has a central area of tooth engaging hard bristles, with areas of softer bristles at the ends for effective gum massaging.

7 Claims, 8 Drawing Figures

COMBINED TOOTHBRUSH AND GUM MASSAGE DEVICE

The present invention relates to dental hygiene appliances and more particularly to such devices which provide particularly effective toothbrushing action as well as gum massage.

It has long been recognized that proper dental hygiene requires regular and effective gum massage as well as regular and effective toothbrushing. It has also been recognized that gum massaging and toothbrushing functions require different patterns of motion and usually require different types of mechanical devices.

The conventional toothbrush is not generally effective for gum massage. Since most persons do not acquire special gum massage devices, the need for effective gum massage usually goes unanswered.

Proposals have been made in the past for devices supposedly capable of providing dual functions of toothbrushing and gum massage. Such proposals for example are disclosed in U.S. Pat. Nos. 1,326,638; 1,840,384; 3,474,481; 3,398,421; 3,678,528; and 4,020,521.

However, insofar as can be determined, these devices have not come into widespread use and have not met with consumer acceptance because of their cost, complexity or because they do not properly perform their intended functions.

With the foregoing considerations in mind it is the principal purpose and object of the present invention to provide an improved simplified, relatively low cost combined toothbrushing and gum massaging device which permits the user to perform both functions easily and effectively.

It is an additional major object of the invention to provide an improved combined toothbrush and gum massaging device having an improved bristle arrangement which in use facilitates the performance of the separate toothbrushing and gum massaging functions.

In attaining these and other objects the present invention provides a brushing device having an elongated handle on which a bristle carrying head is pivotally mounted between two operating positions, the first being particularly adapted to facilitate toothbrushing and the second being particularly adapted to facilitate gum massage operations.

The bristle carrying head has a central area of relatively hard tooth engaging bristles with areas of softer bristles at the ends for effective gum massage.

Additional advantages and objects of the invention will become apparent as the description proceeds.

PREFERRED EMBODIMENTS

The invention comprises a toothbrush assembly 11 wherein a bristle carrying head 13 is mounted upon one end of a handle member 12 for adjustment between 90° apart operational positions.

Figure 1:
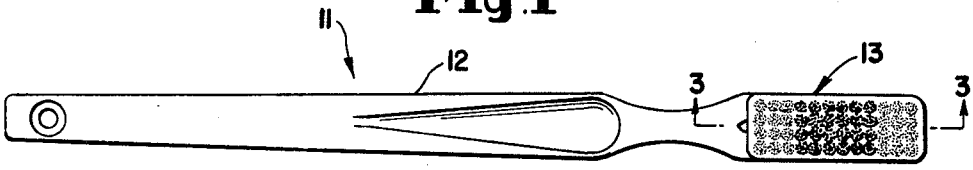
FIG. 1 is a plan view of a toothbrush with the adjustable bristle carrying head in normal tooth cleaning position.
Figure 2:
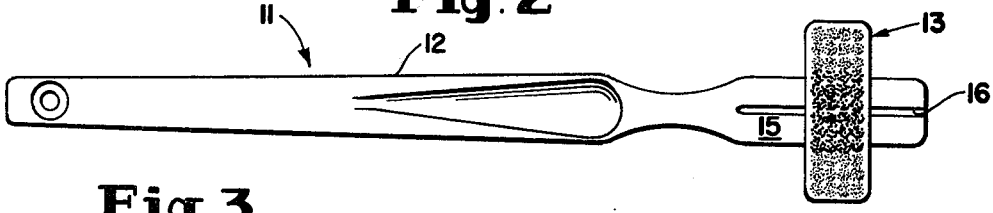
FIG. 2 is a plan view of the toothbrush of FIG. 1 showing the bristle carrying head in gum massage position.

In FIG. 1 the head 13 is disposed in substantial alignment with the handle, and in FIG. 2 the head has been turned to extend substantially at right angles to the length of the handle.

The handle at the bristle carrying head end is formed with a through smooth bore cylindrical opening 14. The handle has a smooth planar front surface 15 surrounding and extending perpendicularly to the axis of the opening, and that surface has linear locking recesses or grooves 16 and 17 that intersect the edge of opening 14. Recess 16 is preferably the longer and extends parallel to the length of the handle, and recess 17 is shorter but extends entirely laterally across the handle surface. The recesses extend at right angles to each other, and are preferably of the same size and contour from end to end.

The bristle carrying head 13 is preferably a generally rectangular solid block 18 of hard plastic normally the same material as the handle having the length and width of the bristle carrying end of the conventional toothbrush. Thus the width of the block is substantially the width of the handle surface beneath it, so that as shown in the FIG. 1 position it may lie within the confines of the handle lateral dimensions. Typically surface 15 and the block may be about 7/16" wide, and surface 15 and the block may be about 1-3/16" long.

The rear surface 19 of block 18 which is adapted to engage the handle surface 15 is similarly smooth and planar.

Projecting from surface 19 substantially centrally of block 18 is an integral smooth surfaced cylindrical mounting stem 20, which, in the assembly, extends through opening 14. A central integral locking rib 21 extends along surface 19 from end to end of the block 18. Rib 21 is the same cross section as grooves 16 and 17.

The back of the handle is provided with an annular recess 22 providing a spring seat 23 surrounding opening 14. An annular spring element in the form of a slightly concave washer 24 of non-corrosive metal or plastic surrounds the stem 20 and rests on seat 23. In a preferred embodiment heat is applied to the end of stem 20 after the block 18 is mounted on the surface 15 with rib 19 in a groove 16 or 17 to rivet over the stem and form the enlarged retaining button 25 that traps washer 24 axially resiliently between seat 23 and the stem.

Figure 3:
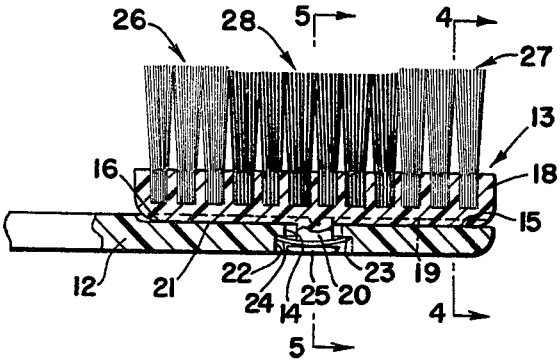
FIG. 3 is an enlarged section showing detail of the mounting of the bristle carrying head in the handle.
Figure 4:
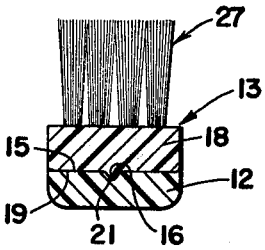
FIG. 4 is a section substantially on line 4—4 of FIG. 3 showing the locking rib and channel.
Figure 6:
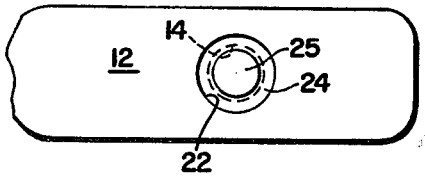
FIG. 6 is a plan view showing the back of the handle and the bristle head end.
Figure 5:
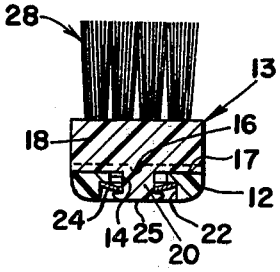
FIG. 5 is a section substantially on line 5—5 of FIG. 3 showing further detail.
Figure 7:
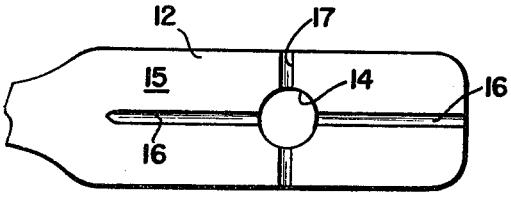
FIG. 7 is a plan view of the handle end with the bristle carrying head removed, showing the locking recess arrangement.
Figure 8:
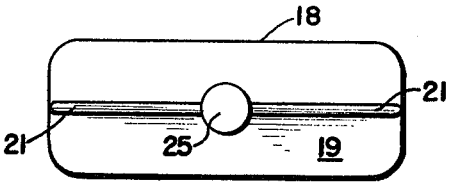
FIG. 8 is a plan view of the rear of the bristle carrying head showing the locking rib structure.

The dimensions of the parts are such that, as shown, the depth of each groove 16 and 17 is about equal to the axial distance that stem 20 may move in opening 14 while compressing the washer 24. In locked position as illustrated in FIGS. 3 and 4 the rib 21 is entirely within groove 16 with flat surfaces 15 and 19 urged into engagement by the spring washer. The length of stem 20 is such that its enlarged end is received in recess 22.

The cross sectional shape of grooves 16 and 17 and correspondingly that of rib 19 is round. Thus, to change the bristle head orientation between the position shown in FIGS. 1 and 2 the user need only grip the block with his fingers and turn it until the rib 19 comes out of its engaged groove, as permitted by spring washer 24, and slides over surface 15 to the other groove where, upon release of the block, the rib 21 is pulled into seat in the other groove 17, and effectively locks the head in that position perpendicular to the original position.

A preferable bristle arrangement is shown. The end groups 26 and 27 bristles on the block are slightly longer and softer than the central group 28, a generally concave array being presented. The central group may advantageously extend about half the length of the head, with the softer end groups, 26 and 27, each extending about half the length of the harder group 28.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A combined toothbrush and gum massage assembly comprising an elongated handle member, a bristle carrying head member pivotally mounted on said handle member near one end for movement between a first operating position in substantial alignment with the length of such handle member and a second operating position substantially at right angles to the length of said handle member, and resiliently biasing said head member toward said handle member to maintain locking engagement between said members in each of said two positions, one of said members having a pivot stem rotatably mounted on the other member, and cooperating rib and groove means capable of resisting displacement of said head member from either of said locked positions during normal toothbrushing and/or gum massaging operations, but being readily responsive to torque applied by a user to turn the head member from one position to another being provided on said members to interlock at said positions.

2. The assembly defined in claim 1, wherein resilient means is provided between said stem and said other member for biasing said members together.

3. The assembly defined in claim 1, wherein said members having facing planar surfaces and said head member has a pivot stem rotatably journalled in said handle member.

4. The assembly defined in claim 2, wherein said rib and groove means are of such formation as to come out of interlocking relation when said head is subject to torque for turning about the axis of said stem.

5. The assembly defined in claim 4, wherein said rib and groove means comprise right angle intersecting linear grooves in said handle surface aligned with the axis of said stem, and at least one linear rib on said head, all of said grooves and said rib being of similar lateral cross section.

6. The assembly defined in claim 3, wherein said pivot stem is integrated with said head member and projects through a bore in said handle member that terminates in a back surface recess in the handle member, and the end of said stem is enlarged within the recess.

7. The assembly defined in claim 6, wherein an axially resilient spring member surrounds the stem, and is disposed between the enlarged end of said stem and an annular seat in said recess.

* * * * *